United States Patent [19]

Tian

[11] 4,299,071

[45] Nov. 10, 1981

[54] BRICKS

[76] Inventor: Khoo Tian, 316B, Jalan Pudu, Kuala Lumpur, Malaysia

[21] Appl. No.: 139,696

[22] Filed: Apr. 11, 1980

[30] Foreign Application Priority Data

Apr. 11, 1979 [GB] United Kingdom ..... 12715/79

[51] Int. Cl.[3] ..... E04C 1/10

[52] U.S. Cl. ..... 52/593; 428/49; 428/192

[58] Field of Search ..... 52/591, 593; 428/192, 428/49

[56] References Cited

U.S. PATENT DOCUMENTS

| | | | |
|---|---|---|---|
| 229,766 | 7/1880 | Smith | 52/593 |
| 1,365,162 | 1/1921 | Ferguson | 52/591 |
| 1,984,393 | 12/1934 | Brown | 52/593 X |

*Primary Examiner*—Henry F. Epstein

*Attorney, Agent, or Firm*—Browdy and Neimark

[57] ABSTRACT

Bricks which include a V-shaped depression in the top surface of the brick, extending lengthwise along the brick. The brick may be formed with vertically extending ridge-like projections in one end face thereof and a plurality of vertical grooves in the opposite end face.

5 Claims, 7 Drawing Figures

BRICKS

This invention relates to bricks and to their manufacture.

According to one aspect of the present invention, there is provided a brick one end face of which is formed with vertically extending ridge-like projections extending out of the plane of, and at or close to the vertical edges of, said one face.

A brick as defined above may be bonded lengthwise to a similar brick by employing mortar which fills the gap between the end projections of the brick. In this way an adequate bond is achieved between adjacent bricks, using less mortar than with conventional, planar bricks and also giving an aesthetically pleasing appearance to the end product.

Although it is not essential, it is advantageous for the end face of the brick opposite to the first mentioned end face to be formed with a plurality of vertical grooves. These grooves can extend over that portion of the face which corresponds in position with the gap between the projections on the first mentioned end face. By this means, adhesion of mortar between end faces of adjacent bricks is increased. The grooved end face of the brick is also pleasing in appearance.

According to another aspect of the present invention, there is provided a brick the top surface of which includes a V-shaped depression extending lengthwise along the brick and occupying a major proportion of the top surface of the brick.

Preferred embodiments of the present invention incorporate both the first and second aspects as stated above. Preferably, the V-shaped depression on the top surface of the brick is of the same width as the gap between the projections on said one end face of the brick.

The invention also provides a method of manufacturing bricks which is suitable for producing conventional bricks as well as the particular design of brick which is the subject of this invention. Accordingly, a third aspect of the present invention provides a method of manufacturing earth bricks, comprising (a) excavating earth from the ground; (b) removing coarse particles from the earth to leave fine particles; (c) adding to said fine particles an additive comprising oxides of calcium, silicon, and of aluminium or aluminium and iron; (d) placing the mixture thus obtained into a mould and pressing the mixture to shape it in the mould; and (e) removing the shaped material from the mould and allowing it to dry. Coarse particles can be removed from the exacavated earth by, for example, a drying step followed by a grinding step; an alternative method is to allow the coarse particles to sediment out of an aqueous dispersion of earth particles. Such sedimentation can be assisted by churning the earth particles with water to form a sludge which can then be poured onto the ground to drain.

The additive which is incorporated into the fine earth particles preferably comprises 65% quicklime, 25% silica and 10% of an aluminium oxide-ferric oxide mixture. 8–10 parts of additive may be incorporated for each 100 parts (by weight) of ground earth particles. After the bricks have been removed from their moulds, they can be stacked to dry naturally. It is not necessary to fire the bricks before they are suitable for use.

The additive can be formulated either as a mixture of bulk chemicals or as a mixture of commercially available materials which may include Pozzolanic cement, Portland cement, slag cement and high alumina cement. The preferred material is Portland cement. The following table illustrates the proportions of the principal compounds in these four materials and in commercially available quicklime:

| Additive Component | $SiO_2$ | $Al_2O_3$–$Fe_2O_3$ | CaO |
|---|---|---|---|
| 1. Lime | 1%–5% | 1%–3% | 90%–95% |
| 2. Pozzolanic Cement | 45%–55% | 35%–45% | 2%–8% |
| 3. Portland Cement | 23%–28% | 8%–12% | 62%–68% |
| 4. Slag Cement | 27%–32% | 12%–16% | 55%–60% |
| 5. Alumina Cement | 8%–10% | 45%–50% | 40%–45% |

For a better understanding of the invention, and to show how the same may be carried into effect, reference will now be made by way of example, to the accompanying drawings, in which.

Figure 1:
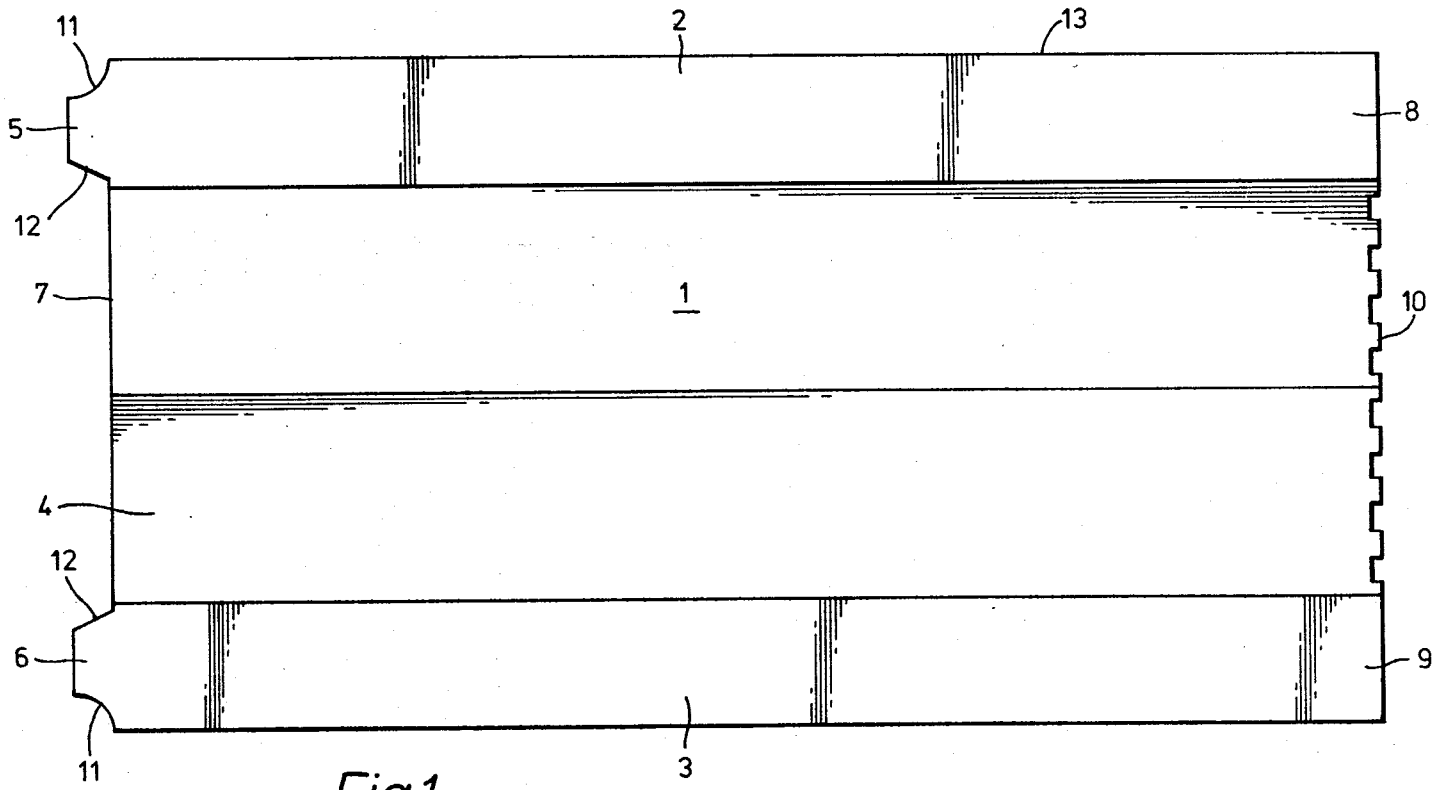
FIG. 1 is a plan view of the preferred brick of the invention.
Figure 2:
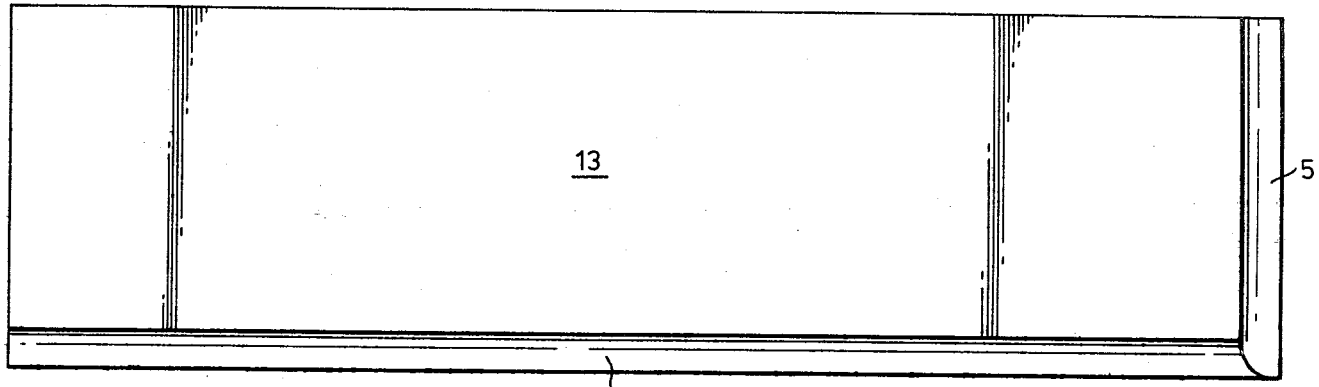
FIG. 2 is a side elevation of the brick shown in FIG. 1.
Figure 4:
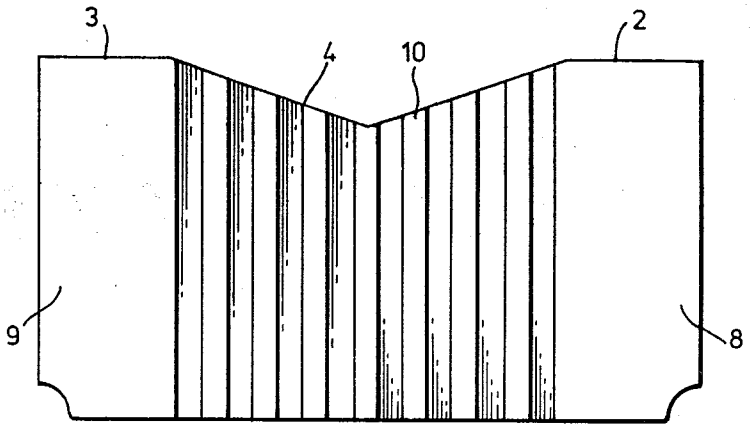
FIG. 4 is an end elevation of the right hand end of the brick shown in FIG. 1.
Figure 3:
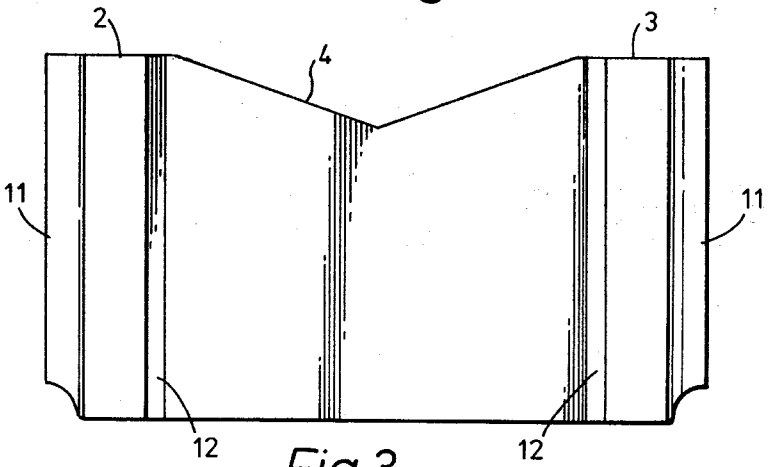
FIG. 3 is an end elevation of the left hand end of the brick shown in FIG. 1.

Referring first to FIGS. 1 to 4, the brick 1 has an upper surface comprising edge portions 2 and 3 separated by a V-shaped groove 4. The left hand end of the brick has two vertical projections 5 and 6 separated by a planar region 7. The right hand end of the brick includes planar regions 8 and 9 between which there is an area 10 formed of the vertically disposed grooves which, in plan, have a castellated appearance (see FIG. 1). Projections 5 and 6 have outwardly facing curved portions 11, and inwardly facing planar portions 12. The side walls 13 of the brick are plain.

Figure 5:
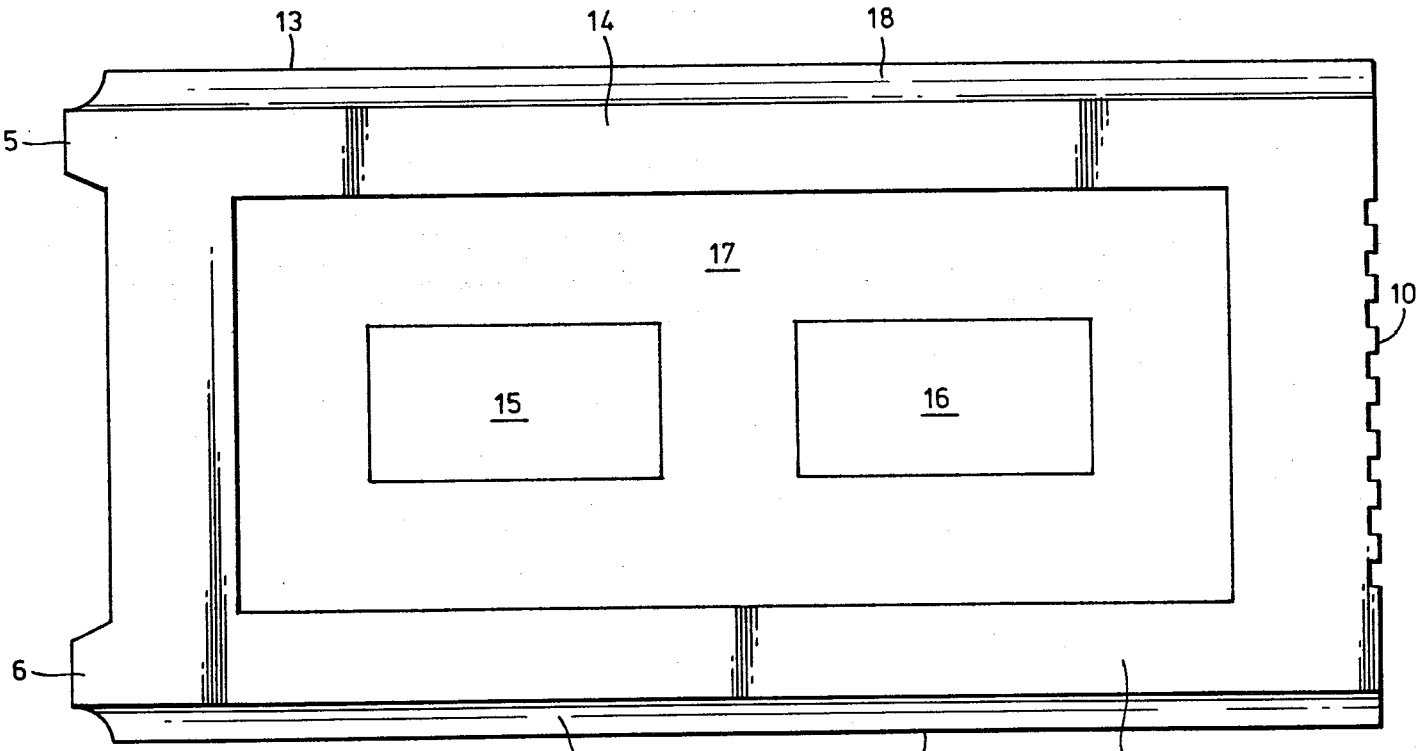
FIG. 5 is a plan view of the base of the brick shown in FIG. 1.

Referring now to FIG. 5, the underside of the brick comprises a peripheral area 14 and two rectangular areas 15 and 16, the areas 14, 15 and 16 being separated from one another by a recessed area 17. The lateral edges 18 of the brick are upwardly and outwardly curved so as to meet the side wall portions 13 (see FIG. 2).

Figure 6:
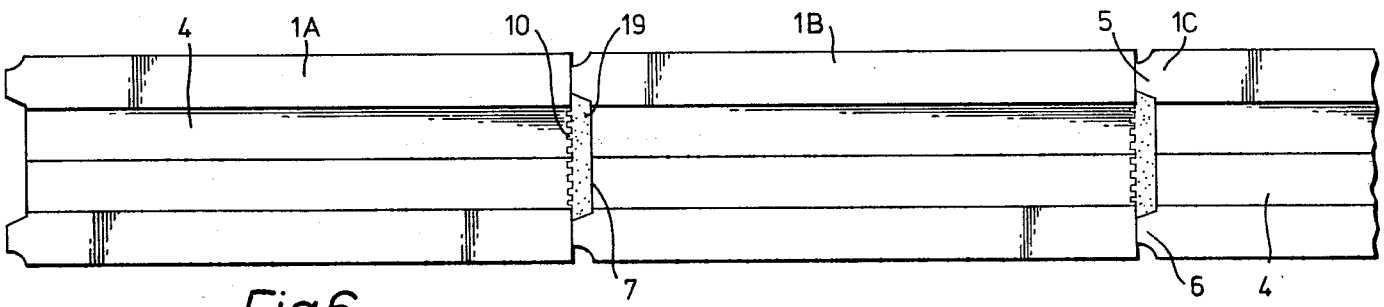
FIG. 6 is a plan view of a series of bricks such as that shown in FIG. 1 bonded together end to end.
Figure 7:
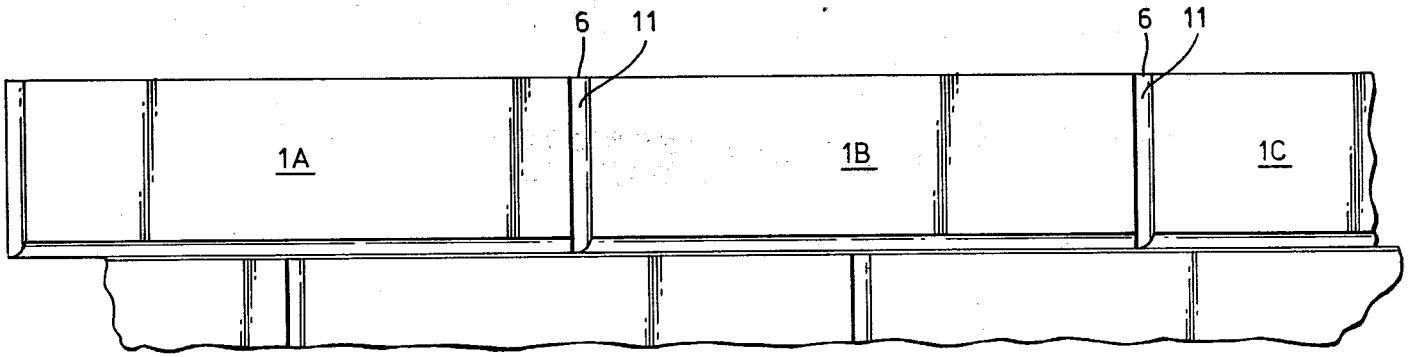
FIG. 7 is a side elevation of the arrangement shown in FIG. 6.

Referring now to FIGS. 6 and 7, a number of identical bricks in accordance with this invention are shown bonded lengthwise one to another. Individual bricks are marked 1A, 1B and 1C. As seen in FIG. 6, a layer of mortar 19 occupies the space between surfaces 10 and 7 of adjacent bricks. As shown in FIG. 7 projections 5 and 6 serve to obscure the mortar 19 from view in side elevation. The mortar which is in place between adjacent horizontal layers of bricks is likewise invisible in side elevation. The mortar fits into the area defined between the V-shaped groove 4 of the lower brick and the recessed surface portion 17 of the brick above. In this way, satisfactory bonding is achieved between adjacent bricks in one layer, and between adjacent layers of bricks, while the whole structure presents an attractive appearance from the outside. The end faces of the bricks may also be used to present decorative features in appropriate constructions.

What is claimed is:

1. In a brick comprising a top surface, a bottom surface and two end surfaces, the improvement in which the top surface and one of the two end surfaces are each formed with an indented region such that a plurality of identical bricks can be bonded together in an abutting, non-interlocking manner by placing a bonding agent in the said indented regions to form thereby a wall or other structure in which the bonding agent is fully concealed, the indented region in the top surface of the brick being in the form of a V-shaped depression extending lengthwise along the brick and occupying a major porportion of the top surface of the brick; and in which the bottom surface of the brick is formed with at least one indented area.

2. A brick as claimed in claim 1, wherein said end face of the brick opposite to said end face with the indented region is formed with a plurality of vertical grooves.

3. A brick as claimed in claim 1, wherein said end face with the indented region comprises two vertically extending ridge-like projections extending therefrom and at or close to the vertical edges thereof to define therebetween the indented region; said end face of the brick opposite to said end face with the indented region being substantially planar.

4. A brick as claimed in claim 3, wherein said substantially planar end face is formed with a plurality of vertical grooves.

5. A brick as claimed in claim 3, wherein said vertically extending ridge-like projections have outwardly facing curved portions; and wherein said bottom surface is provided along two opposite edges with upwardly and outwardly curved portions.

* * * * *